US005562090A

United States Patent [19]

Katz

[11] Patent Number: 5,562,090

[45] Date of Patent: Oct. 8, 1996

[54] OVEN DOOR HAVING A COOLING ARRANGEMENT

[75] Inventor: Jonathan M. Katz, Louisville, Ky.

[73] Assignee: General Electric Company, Louisville, Ky.

[21] Appl. No.: 96,367

[22] Filed: Jul. 22, 1993

[51] Int. Cl.[6] ..... F23M 7/00

[52] U.S. Cl. ..... 126/198; 126/200

[58] Field of Search ..... 126/190, 193, 126/198, 200, 21 R; 219/400, 522, 391, 396

[56] References Cited

U.S. PATENT DOCUMENTS

| | | | |
|---|---|---|---|
| 3,057,341 | 10/1962 | Perl | 126/198 |
| 3,489,135 | 1/1970 | Astrella | 126/200 |
| 3,710,776 | 1/1973 | Frick | 126/200 |
| 3,717,138 | 2/1973 | Upp | 126/200 |
| 3,818,890 | 6/1974 | Evans et al. | 126/200 |
| 3,855,994 | 12/1974 | Evans et al. | 126/198 |
| 3,893,442 | 7/1975 | Nuss | 126/198 |
| 4,084,571 | 4/1978 | McFarland | 126/198 |
| 4,207,863 | 6/1980 | Drouin | 126/198 |
| 4,716,884 | 1/1988 | Bonacorsi et al. | 126/198 |

FOREIGN PATENT DOCUMENTS

| | | | |
|---|---|---|---|
| 277923 | 8/1988 | European Pat. Off. | 126/198 |
| 2013872 | 8/1979 | United Kingdom | 126/198 |

*Primary Examiner*—James C. Yeung
*Attorney, Agent, or Firm*—H. Neil Houser

[57] ABSTRACT

An oven door has a substantially vertical air passage through which air flows by convection. Air enters the air passage through air inlets at the bottom of a substantially rectangular decorative trim frame, which supports a front pane of glass, and the bottom of an inner liner to which the frame is attached. Air in the air passage flows over the substantially rectangular front pane of glass along its inner surface. The frame has air outlets, which are above the front pane of glass and communicate with the air passage to provide the only exit, to direct air substantially horizontally in the substantially horizontal plane of a handle assembly on the door. The frame has a baffle disposed within the air passage for deflecting air therefrom through the air outlets and over the handle gripping portion. The air passage is closed above the baffle, and stagnant air above the baffle functions as a heat insulator. Heat insulating door end caps overlie the sides of the frame and the front pane of glass from above the top of the frame to beneath the upper edge of the front pane of glass. The handle assembly includes a handle gripping portion and handle end caps, which mount the handle gripping portion on the door and are heat insulators.

19 Claims, 8 Drawing Sheets

OVEN DOOR HAVING A COOLING ARRANGEMENT

CROSS REFERENCE TO RELATED APPLICATIONS

Applicant's copending patent application for "Oven Door Construction," Ser. No. 08/096,365, (Attorney Docket No. 9D-RG-18511) and filed concurrently with this application on Jul. 22, 1993, and the copending patent application of Jonathan M. Katz et al for "Handle Assembly," Ser. No. 08/096,366, (Attorney Docket No. 9D-RG-18512) filed concurrently with this application on Jul. 22, 1993.

FIELD OF THE INVENTION

This invention relates to a cooling arrangement for an oven door.

BACKGROUND OF THE INVENTION

Oven doors, particularly those used with self-cleaning ovens, are subjected to relatively high temperatures, particularly during a self-cleaning cycle. Various arrangements for directing air through an oven door to cool an outer or front panel have previously been suggested. Examples of these air flow arrangements are disclosed in U.S. Pat. No. 3,710,776 to Frick, U.S. Pat. No. 3,717,138 to Upp, U.S. Pat. No. 3,818,890 to Evans et al, U.S. Pat. No. 3,893,442 to Nuss, U.S. Pat. No. 4,084,571 to McFarland, U.S. Pat. No. 4,207,863 to Drouin, and U.S. Pat. No. 4,716,884 to Bonaccorsi et al.

Each of the aforesaid patents includes a pane of glass forming at least a portion of its outer surface with a substantially vertical air passage extending therethrough to cool portions of the outer surface of the door and the pane of glass. Most of the arrangements of the aforesaid patents have a relatively large number of parts including special support means for supporting the pane of glass.

Furthermore, only the aforesaid Bonaccorsi et al patent has an air flow arrangement in which air exits at its upper end adjacent a handle of the door. However, in the aforesaid Bonaccorsi et al patent, the path of the air flow from the air passage is down from the handle so as to not provide air flow from the air passage through air outlets in the same plane as the handle and toward the handle. Additionally, the aforesaid Bonaccorsi et al patent requires a fan in the oven to produce the air flow, which increases the manufacturing cost and decreases the energy efficiency.

The cooling arrangement of the present invention satisfactorily overcomes the problems of the aforesaid patents by achieving sufficient cooling by way of convective air flow. Thus, the cooling arrangement of the present invention eliminates the need for a fan as is required in the aforesaid Bonaccorsi et al patent. The cooling arrangement of the present invention also directs air from the air passage through air outlet means in substantially the same horizontal plane as the handle, thereby cooling the handle as well.

The cooling arrangement of the present invention also limits the temperature of the oven door above the pane of glass and beneath the air outlet means to acceptable limits through the use of a combined heat shield/reflector, which is supported adjacent the upper end of the pane of glass.

SUMMARY OF THE INVENTION

An oven door has a substantially rectangular front pane of glass supported in substantially rectangular frame means attached to an inner liner. The oven door has substantially vertical air passage means extending therethrough to direct air from air inlet means at the bottom of at least one of the frame means and the inner liner over the inner surface of the front plane of glass. The frame means has air outlet means disposed above the front pane of glass to communicate with the substantially vertical air passage means. Deflecting means on the frame means deflects the air from the substantially vertical air passage means through the air outlet means in a substantially horizontal direction. The upper end of the substantially vertical air passage means is closed above the deflecting means so that all air in the substantially vertical air passage means exits only through the air outlet means.

An object of this invention is to provide an oven door having a cooling arrangement in which cooling air flows upwardly through the oven door by convection.

Another object of this invention is to provide an oven door for a self-cleaning oven in which the oven door has its outer surface maintained at a temperature no greater than a desired temperature by air flow through an air passage within the oven door.

A further object of this invention is to provide a windowed oven door cooled by air flow through a passage in the oven door.

Other objects of this invention will be readily perceived from the following description, claims, and drawings.

DESCRIPTION OF THE DRAWINGS

The attached drawings illustrate a preferred embodiment of the invention, in which.

DESCRIPTION OF THE PREFERRED EMBODIMENT

Figure 1:
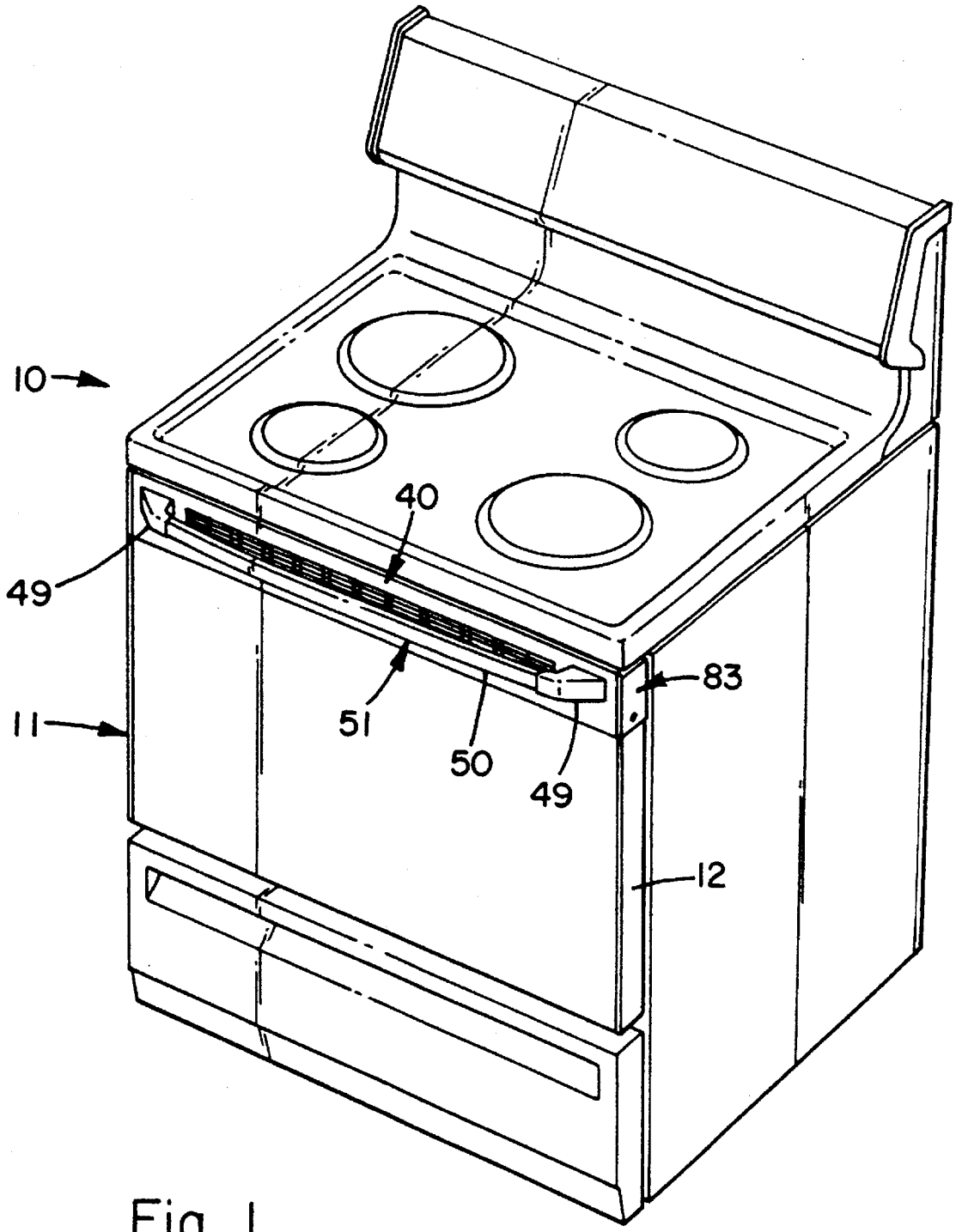
FIG. 1 is a perspective view of an electric range having a pivotally mounted oven door within which is disposed a substantially vertical air passage of the present invention.

Referring to the drawings and particularly FIG. 1, there is shown an electric range 10 having an oven door 11 pivotally mounted thereon. It should be understood that the range 10 could be a gas range, if desired, since the oven door 11 can be used with either an electric or gas range. All reference in the specification and claims to horizontal, vertical, front, outer, upper, lower, inner, and rear are with the oven door 11 in its closed position.

The door 11 includes a substantially rectangular shaped front pane 12 of glass. The front pane 12 of glass has ground penciled edges. The side edges of the front pane 12 of glass are exposed to provide a decorative appearance.

Figure 3:
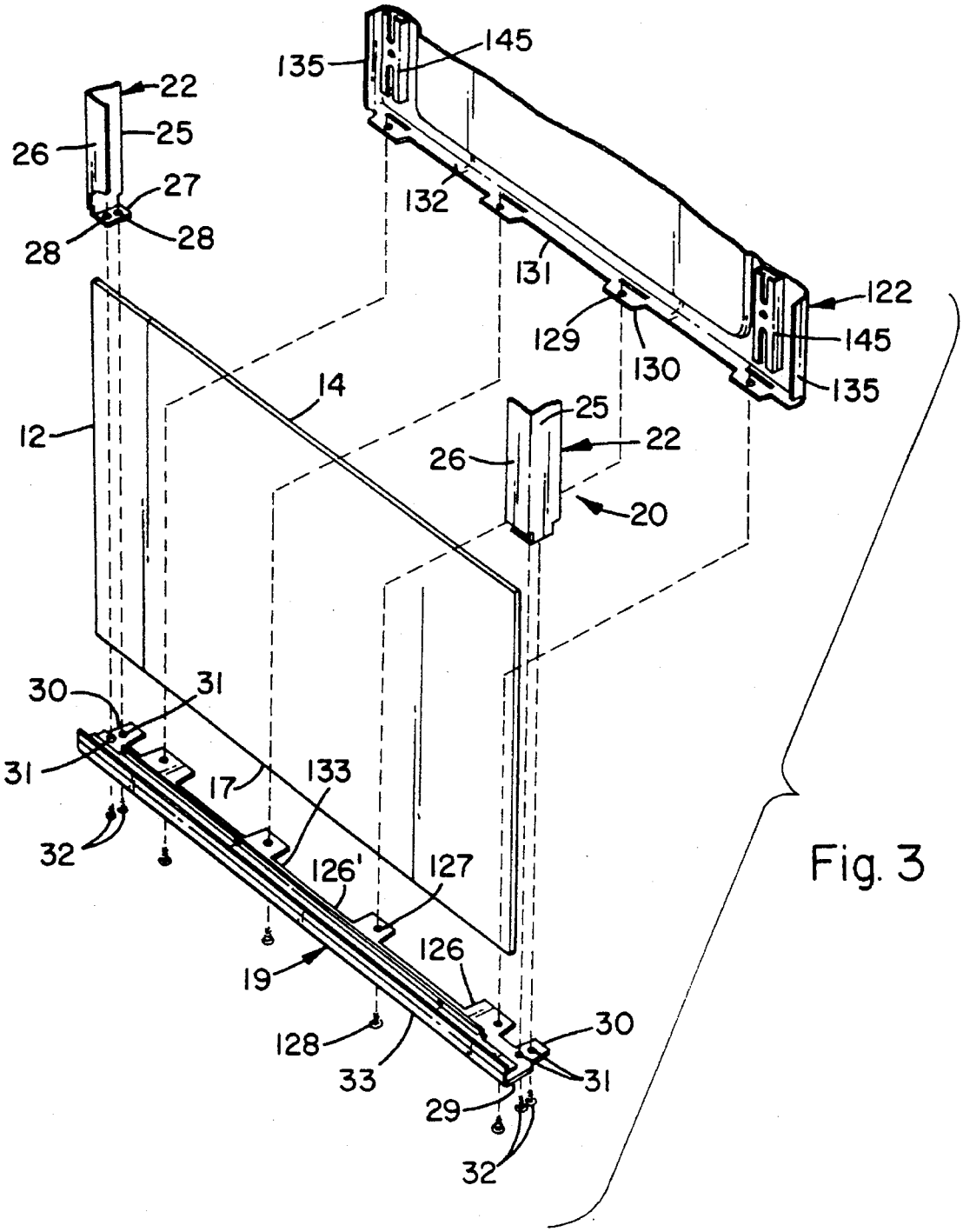
FIG. 3 is a perspective view of the remainder of the outer or front frame of the oven door and showing a bottom portion of the inner liner and bottom portions of legs of a U-shaped door trim frame.
Figures 4, 9, 10:
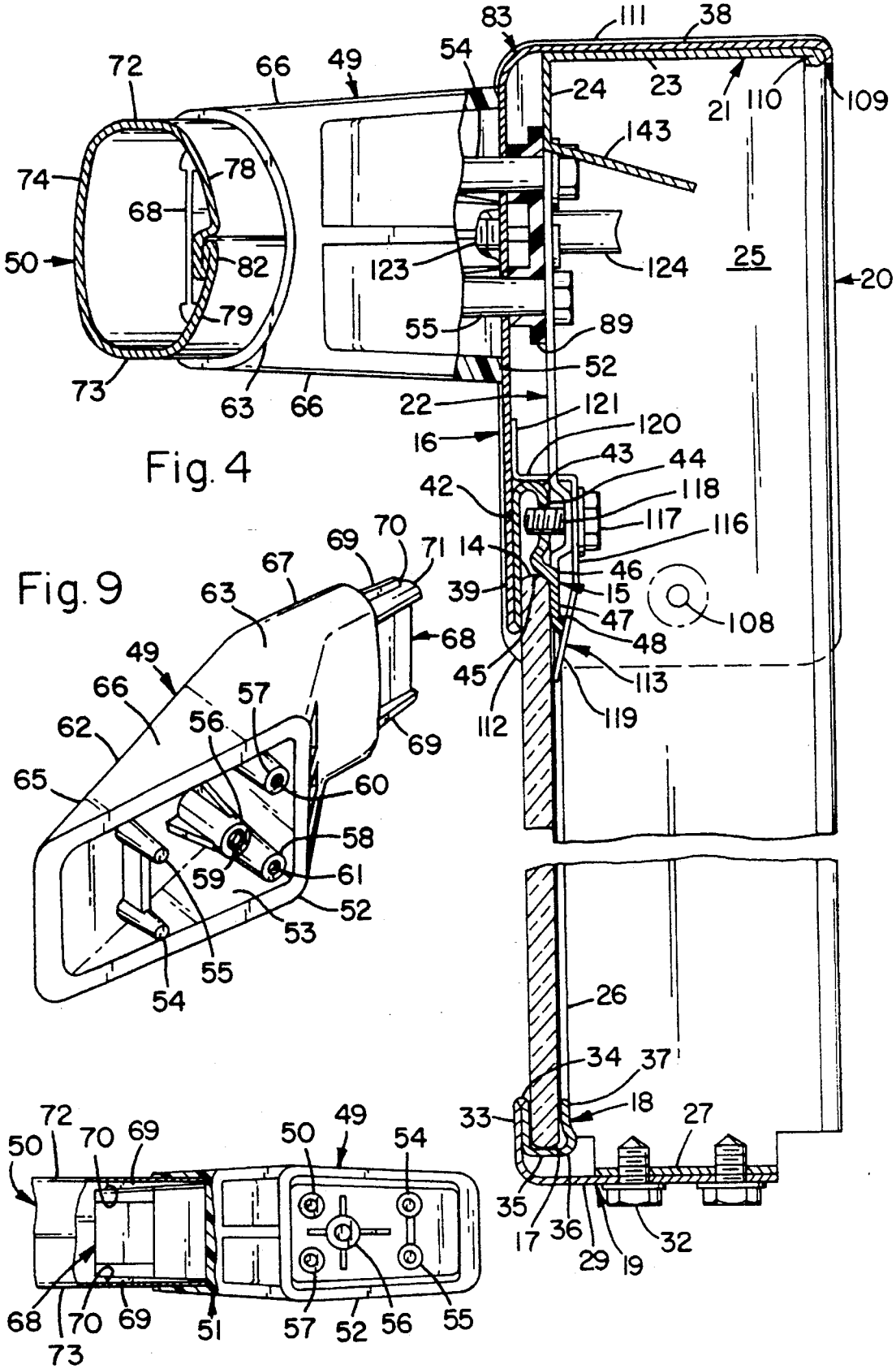
FIG. 4 is an enlarged fragmentary side sectional view, partly in elevation, of the oven door and a handle assembly attached to the oven door.
FIG. 9 is a perspective view of a handle end cap of the handle assembly of FIG. 8.
FIG. 10 is a fragmentary rear elevational view showing an end of a handle gripping portion of the handle assembly retained within one of the handle end caps of the handle assembly.

As shown in FIGS. 3 and 4, the front pane 12 of glass has its upper edge 14 supported in a channel 15 of a vent or upper trim frame 16. The front pane 12 of glass has its bottom edge 17 supported in a channel 18 of a bottom trim frame 19. The side edges of the front pane 12 of glass are exposed to provide a decorative appearance.

Figures 2, 5:
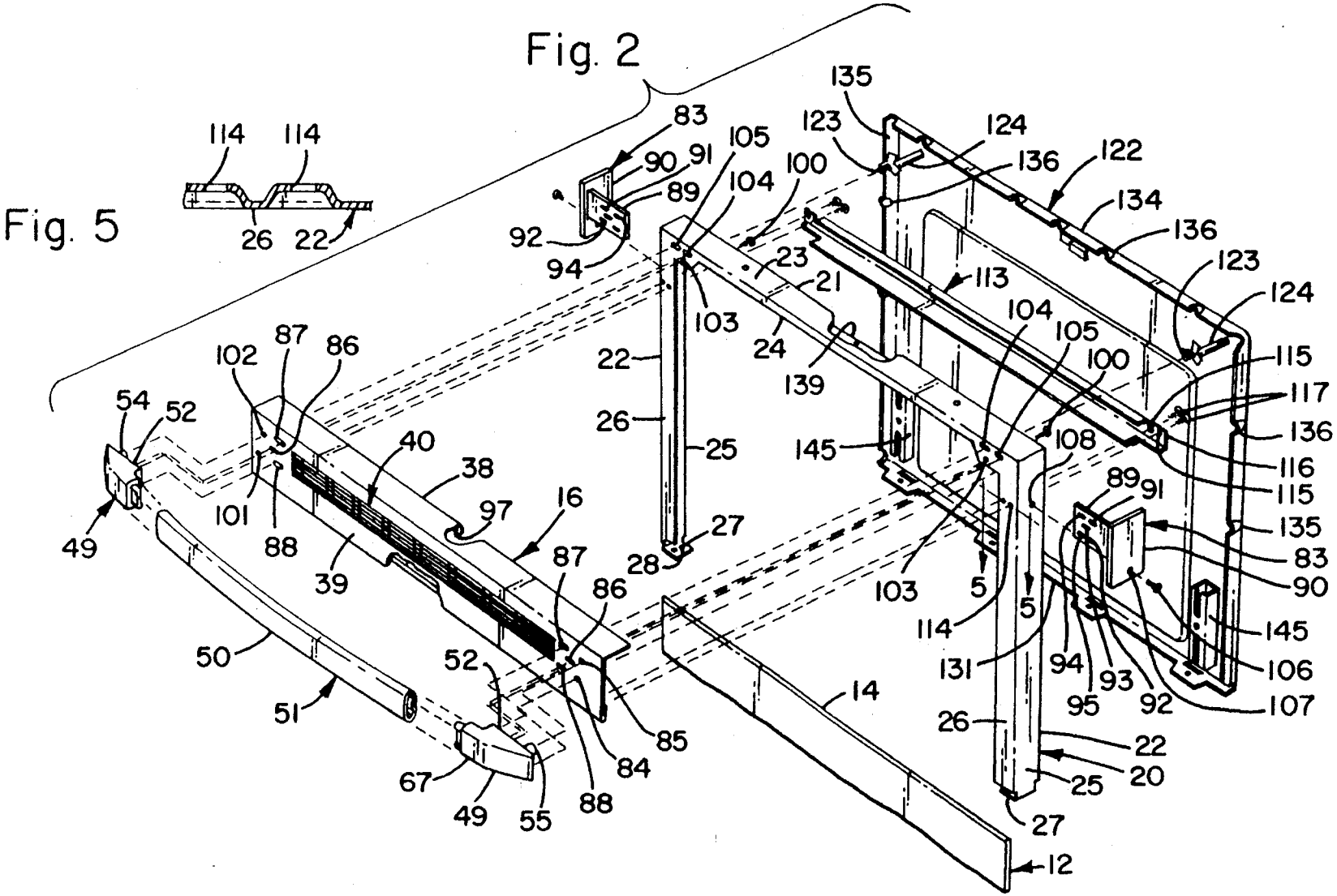
FIG. 2 is an exploded perspective view of a portion of an outer or front frame of the oven door and an inner liner of the oven door to which the frame is attached.
FIG. 5 is a fragmentary sectional view of a portion of one of the legs of the U-shaped door trim frame taken along line 5—5 of FIG. 2 and showing holes through which screws extend to attach a heat shield/reflector to the U-shaped door trim frame.

Both the vent trim frame 16 and the bottom trim frame 19 are attached to an integrally formed U-shaped door trim frame 20. As shown in FIG. 2, the U-shaped door trim frame 20 includes a top portion or base 21 connected to the upper ends of each of a pair of substantially parallel, vertical legs 22 between which the top portion 21 extends.

The top portion 21 of the U-shaped door trim frame 20 includes a substantially horizontal portion 23 and a substantially vertical portion 24. Each of the legs 22 has a first portion 25 and a second portion 26, which is substantially perpendicular to the first portion 25.

The first portion 25 of each of the legs 22 has a tab 27 at its bottom end and substantially perpendicular thereto. Each of the tabs 27 has a pair of holes 28 therein.

A substantially horizontal portion 29 (see FIG. 3) of the bottom trim frame 19 has a tab 30 at each of its ends. Each of the tabs 30 has a pair of holes 31 therein to receive screws 32, which extend into the holes 28 in each of the tabs 27 of the legs 22 of the U-shaped door trim frame 20 to connect the tabs 27 and 30. Thus, the bottom trim frame 19 and the U-shaped door trim frame 20 are connected to each other to form a substantially rectangular shaped trim frame.

The bottom trim frame 19 includes a first substantially vertical portion 33 extending upwardly from the first substantially horizontal portion 29 as shown in FIGS. 3 and 4. A second substantially vertical portion 34 (see FIG. 4) is connected to the upper end of the substantially vertical portion 33 and extends downwardly to terminate in a second substantially horizontal portion 35, which forms the bottom of the channel 18.

The second substantially horizontal portion 35 has a curved portion 36 extending therefrom and terminating in a third substantially vertical portion 37. The curved portion 36 and the third substantially vertical portion 37 do not extend for the entire width of the bottom trim frame 19 as do the first substantially horizontal portion 29, the first substantially vertical portion 33, the second substantially vertical portion 34, and the second substantially horizontal portion 35. The curved portion 36 and the third substantially vertical portion 37 are shorter to accommodate the second portion 26 of each of the legs 22.

The third substantially vertical portion 37 of the bottom trim frame 19 presses against the front pane 12 of glass to provide an interference fit which retains the bottom portion of the front pane 12 of glass within the channel 18. This also aids in preventing the front pane 12 of glass from moving horizontally.

The vent trim frame 16 includes a substantially horizontal top portion 38 and a first substantially vertical portion 39. As shown in FIG. 2, the first substantially vertical portion 39 has a grill area 40 extending for most of its width. The grill area 40 has a plurality of columns of elongated openings 41 (see also FIG. 6) formed therein in rows to enable air to pass outwardly in a substantially horizontal direction therethrough from the interior of the door 11.

The first substantially vertical portion 39 of the vent trim frame 16 has a second substantially vertical portion 42 connected to its bottom end. A first curved portion 43 is connected to the upper end of the second substantially vertical portion 42.

The first curved portion 43 of the vent trim frame 16 has a third substantially vertical portion 44 connected thereto and extending downwardly therefrom. The bottom end of the third substantially vertical portion 44 has a second curved portion 45 connected thereto. A third curved portion 46 extends from the second curved portion 45 to a fourth curved section 47, which presses against the inner surface of the front pane 12 of glass to form part of the channel 15. Thus, there is an interference fit of the front pane 12 of glass with the second substantially vertical portion 42 and the fourth curved portion 47 of the vent trim frame 16. A fifth curved portion 48 of the vent trim frame 16 extends from the fourth curved portion 47.

Prior to attaching the vent trim frame 16 to the U-shaped door trim frame 20, a handle end cap 49 (see FIG. 2) is attached to each side of the first substantially vertical portion 39 of the vent trim frame 16 adjacent each end of the grill area 40. Each of the handle end caps 49 is formed of a suitable heat insulating material such as a thermoplastic, for example. One suitable example of the thermoplastic is sold by General Electric Company under the trademark XENOY. Each of the handle end caps 49 is formed by injection molding.

Each of the handle end caps 49 supports one end of a handle gripping portion 50, which is a curved, hollow bar having a substantially. D-shaped cross section as shown in FIG. 4. The handle end caps 49 (see FIG. 2) and the handle gripping portion 50 form a handle assembly 51 for the oven door 11 (see FIG. 1).

As shown in FIG. 9, each of the handle end caps 49 has a flat surface 52, which surrounds a recess 53 in the handle end cap 49. The flat surface 52 bears against the first substantially vertical portion 39 (see FIG. 2) of the vent trim frame 16.

The recess 53 (see FIG. 9) has two locator pins 54 and 55 disposed therein and extending beyond the flat surface 52 and substantially perpendicular thereto. As shown in FIG. 2, the locator pin 54 of one of the handle end caps 49 protrudes beyond the flat surface 52 while the locator pin 55 of the other of the handle end caps 49 protrudes beyond the flat surface 52. The handle end caps 49 are the same but one is rotated 180° from the other when mounted on the vent trim frame 16.

As shown in FIG. 9, the recess 53 in the handle end cap 49 has three posts 56, 57, and 58 disposed therein and substantially perpendicular to the flat surface 52. Each of the posts 56, 57, and 58, which terminate in a plane having the flat surface 52, has a hole 59, 60, and 61, respectively, in its end.

A connecting portion 62 of the handle end cap 49 connects the flat surface 52 to a substantially D-shaped handle receiving portion 63, which has a recess 64 (see FIG. 6) to receive an end of the handle gripping portion 50. The connecting portion 62 (see FIG. 9) has its outer surface 65 at an angle of 35° to the flat surface 52 and its side surfaces 66 inclined inwardly towards each other at an angle of 4° as shown in FIG. 4. The handle receiving portion 63 (see FIG. 9) has its outer flat surface 67 at an angle of 3° 15' to a plane parallel to the flat surface 52.

The recess 64 (see FIG. 6) in the handle receiving portion 63 of the handle end cap 49 has a reduced portion 68 disposed therein and extending beyond the end of the handle receiving portion 63. The reduced portion 68 of the handle receiving portion 63 has a substantially H-shaped section with a projecting portion 69 on opposite sides.

Each of the projecting portions 69 has a sloping cam surface 70 at its forward end at an angle of 45° to a surface 71 (see FIG. 9) of the reduced portion 68 beyond which the projecting portion 69 extends. The cam surfaces 70 aid in disposing the reduced portion 68 within an end of the handle gripping portion 50 (see FIG. 6) when the handle gripping portion 50 is received within the recess 64 in the handle receiving portion 63.

Each of the projecting portions 69 engages one of a pair of substantially parallel surfaces 72 and 73 of the handle gripping portion 50 to provide a friction or interference fit therebetween to retain the handle gripping portion 50 within the recess 64 in the handle receiving portion 63. The surfaces 72 and 73 are substantially perpendicular to an outer or front surface 74 of the handle gripping portion 50. Thus, this arrangement maintains the outer or front surface 74 of the handle gripping portion 50 substantially parallel to an outer flat surface 75 of the handle receiving portion 63 of the handle end cap 49.

The handle gripping portion 50 is formed by cold rolled steel into the desired D-shaped cross section. A pair of curved surfaces 78 (see FIG. 4) and 79 extends from the surfaces 72 and 73, respectively.

A seam lock 82 is formed by the edge of the surfaces 78 and 79 overlapping each other. The seam lock 82, located at the middle of the distance between the surfaces 72 and 73, adds strength to the handle gripping portion 50.

The D-shaped cross section for the handle gripping portion 50 is preferred because this cross sectional shape, with the curved portion of the D closest to the oven door 11 makes the handle gripping portion 50 more resistive to bending when subjected to pulling forces, such as would be applied to the handle gripping portion 50 when attempting to open the oven door 11, than would be the case with a handle gripping portion of comparable cross sectional area having a rectangular or square cross section. Other asymmetrical cross sectional shapes could be similarly employed provided the asymmetry is such that the center of mass of the handle gripping portion 50 is closer to the surface 74 of the handle gripping portion 50 remote from the oven door 11 than to the surfaces 78 and 79 of the handle gripping portion 50 proximate the oven door 11.

Figure 8:
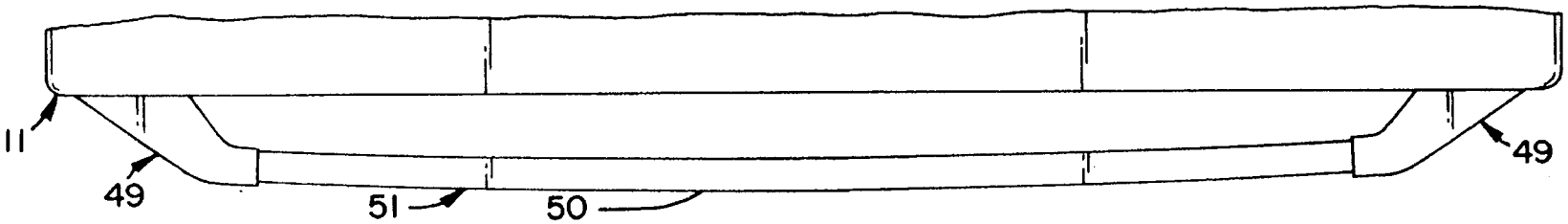
FIG. 8 is a top plan view of a portion of the oven door and the handle assembly attached thereto.

As shown in FIG. 8, the curved handle gripping portion 50 is bowed outwardly relative to the oven door 11 with a radius of curvature so as to substantially improve the ability of the handle gripping portion 50 to resist deformation when subjected to a force applied to the handle gripping portion 50 in the direction toward the oven door 11 such as when pushing against the oven door 11. The desired strength can be achieved with a radius of curvature of the handle gripping portion 50 in the range of 150 inches to 250 inches with a preferred value of 200 inches.

The radius of curvature of the handle gripping portion 50 aids in handling of the oven door 11 during the manufacturing process. The radius of curvature adds strength during home use when a user pushes on the handle gripping portion 50 to push the range 10 (see FIG. 1) into a desired position during installation or after cleaning behind or beneath the range 10. This pushing is in a compressive mode against the convex side of the handle gripping portion 50.

The press or interference fit between each end of the handle gripping portion 50 (see FIG. 6) of the handle assembly 51 and the projecting portions 69 on the reduced portion 68 of the handle receiving portion 63 of the handle end cap 49 enhances the strength of the handle assembly 51 in the tension mode. This additional strength is when there is pulling on the concave side of the handle gripping portion 50.

As best seen in FIG. 2, after the handle end caps 49 of the handle assembly 51 have received the ends of the handle gripping portion 50, each of the handle end caps 49 is secured to the vent trim frame 16 near one of the upper corners thereof and to a door end cap 83. Thereafter, the U-shaped door trim frame 20 is attached to the door end cap 83, the vent trim frame 16, and the handle end caps 49.

Figure 11:
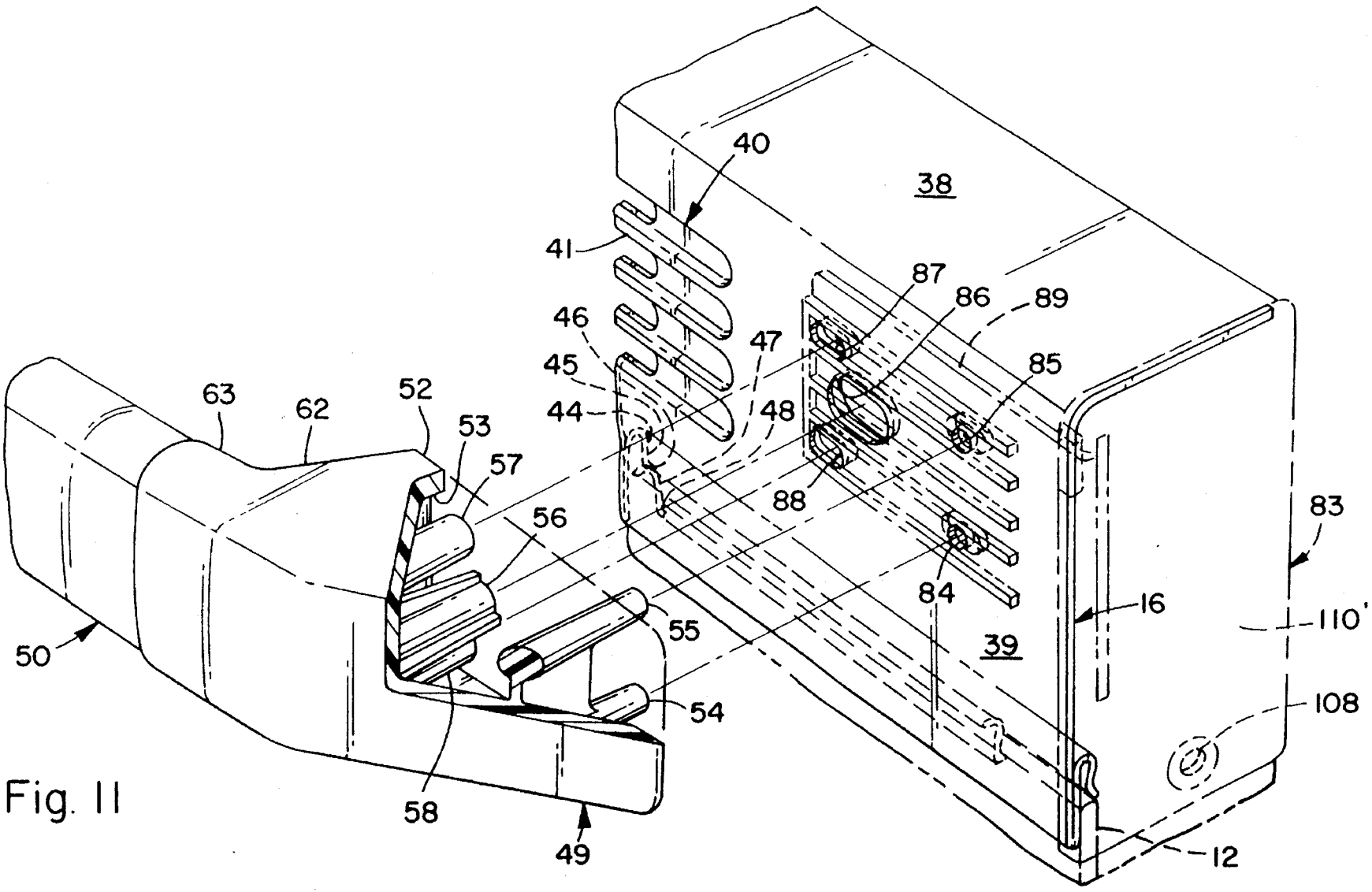
FIG. 11 is a perspective view, partly in section, of the handle end cap and a portion of a vent trim frame of the oven door to which the handle end cap is to be attached.

As shown in FIG. 11, one side of the first substantially vertical portion 39 of the vent trim frame 16 has a pair of holes 84 and 85 therein to receive the locator pins 54 and 55, respectively, on one of the handle end caps 49. As hereinbefore described with reference to FIG. 9, the posts 56, 57, and 58 formed in the handle end cap 49 have formed therein the holes 59, 60, and 61, respectively. The first substantially vertical portion 39 (see FIG. 11) of the vent trim frame 16 has an elongated slot 86 aligned with the hole 59 in the post 56, an upper elongated slot 87 in alignment with the hole 60 in the post 57, and a lower elongated slot 88 aligned with the hole 61 in the post 58.

Each of the legs 22 (see FIG. 2) of the U-shaped door trim frame 20 supports one of the door end caps 83. Each of the door end caps 83 is formed of a suitable heat insulating material such as a thermoplastic, for example. One suitable example of the thermoplastic is a thermoplastic sold by General Electric Company under the trademark XENOY.

Figure 12:
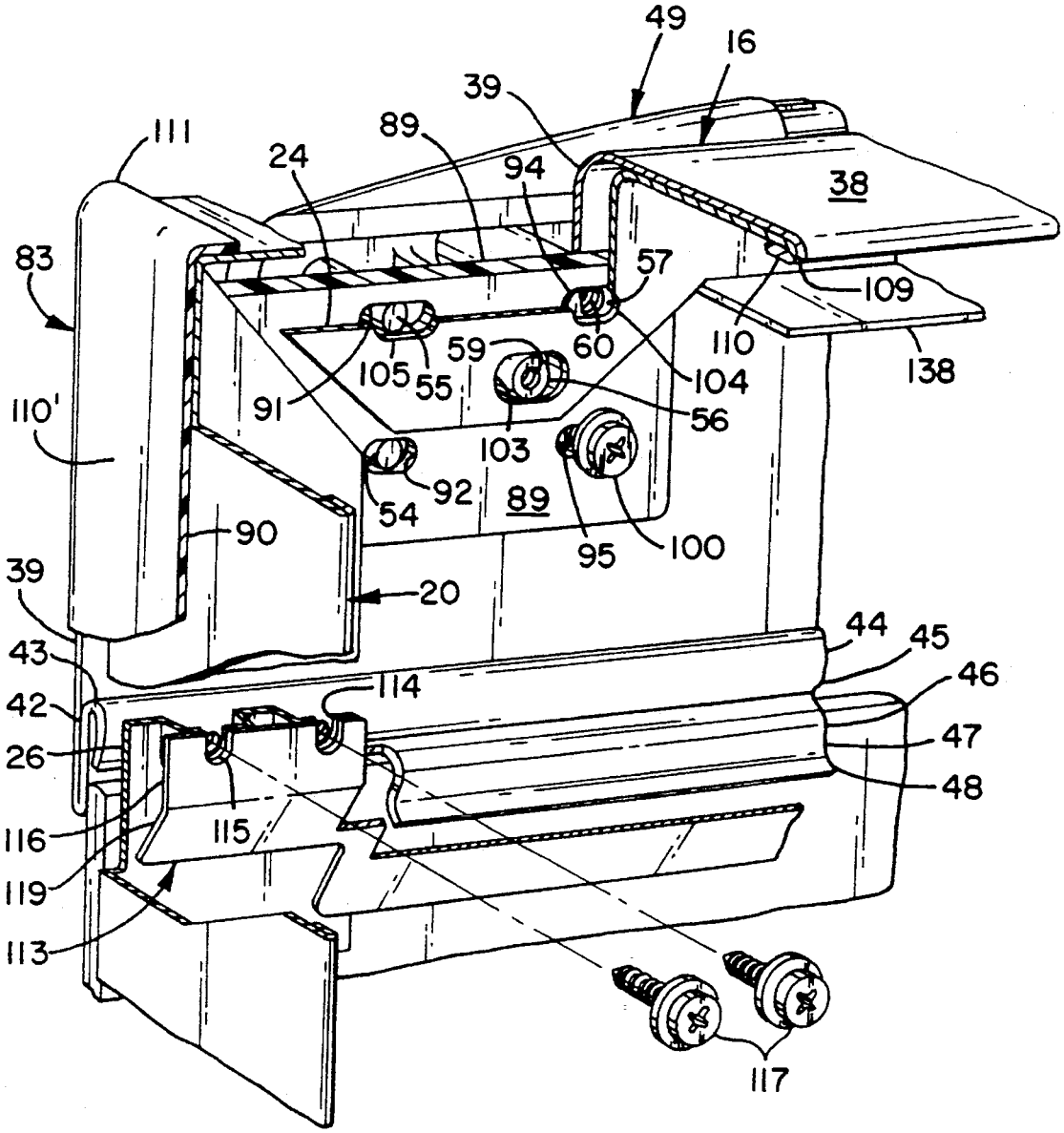
FIG. 12 is a fragmentary perspective view, partly in section, of a rear portion of the outer or front frame of the oven door and showing the attachment of parts of the frame to each other.

As best seen in FIGS. 2 and 12, each of the door end caps 83 includes a first portion 89, which is substantially perpendicular to a second portion 90. The first portion 89 of one of the door end caps 83 has a pair of elongated slots 91 and 92, which receive the locator pins 55 and 54, respectively, of the handle end cap 49 after the locator pins 55 and 54 pass through the holes 85 and 84, respectively, in the vent trim frame 16. The elongated slots 91 and 92 in the other of the door end caps 83 receives the locator pins 54 and 55, respectively, because the two handle end caps 49 are positioned 180° relative to each other.

The first portion 89 of each of the door end caps 83 also has an oval shaped slot 93, which is aligned with the elongated slot 86 in the first substantially vertical portion 39 of the vent trim frame 16. Each of the door end caps 83 has two additional elongated slots 94 and 95, which align with the elongated slots 87 and 88, respectively, in the first substantially vertical portion 39 of the vent trim frame 16.

After the locator pins 54 and 55 are disposed in the holes 84 and 85, respectively, in the first substantially vertical portion 39 of the vent trim frame 16 and the elongated slots 92 (see FIG. 12) and 91, respectively, in one of the door end caps 83, a screw 100 is inserted through the lower elongated slot 95 in the door end cap 83 and the lower elongated slot 88 (see FIG. 11) in the first substantially vertical portion 39 of the vent trim frame 16 into the hole 61 (see FIG. 9) in the post 58 to attach one of the handle end caps 49 to the right side (as viewed in FIG.2) of the vent trim frame 16. As shown in FIG. 2, the left side of the vent trim frame 16 has the three elongated slots 86, 87, and 88 in the same manner as previously described for the right side of the vent trim frame 16. However, the holes 84 and 85 are replaced by elongated slots 101 and 102. This compensates for manufacturing tolerances to enable the handle end caps 49 to be mounted on the vent trim frame 16 and accommodate the handle gripping portion 50.

Furthermore, on the left side of the vent trim frame 16, the screw 100 enters the threaded hole 60 (see FIG. 9) in the post 57. This is because the handle end cap 49 (see FIG. 2) attached to the left side (as viewed in FIG. 2) of the vent trim frame 16 is rotated 180° from the handle end cap 49 attached to the right side of the vent trim frame 16.

After the handle end caps 49 are attached to the vent trim frame 16 and the door end caps 83 with the handle gripping portion 50 held between the handle end caps 49, the vent trim frame 16 is attached to the U-shaped door trim frame 20 through the door end caps 83. The substantially vertical portion 24 of the top portion 21 of the U-shaped door trim frame 20 has an enlarged hole 103 and a pair of elongated slots 104 and 105.

The elongated slot 105 (see FIG. 12) receives one of the locator pins 54 and 55 of the handle end cap 49 depending on which side of the U-shaped door trim frame 20 the handle end cap 49 is disposed. That is, the elongated slot 105 on the right side (as viewed in FIG. 2) of the U-shaped door trim frame 20 receives the locator pin 55 of the handle end cap 49, as shown in FIG. 12, while the elongated slot 105 on the left side (as viewed in FIG. 2) of the U-shaped door trim frame 20 receives the locator pin 54 of the handle end cap 49. The other of the locator pins 54 and 55 of the handle end cap 49 passes beneath the substantially vertical portion 24 of the top portion 21 of the U-shaped door frame 20, as shown in FIG. 12, for the locator pin 54.

Each of the legs 22 (see FIG. 2) of the U-shaped door trim frame 20 has one of the door end caps 83 connected thereto by a screw 106 extending through a countersunk hole 107 in the second portion 90 of the door end cap 83 and into a hole 108 in the first portion 25 of the leg 22 of the U-shaped door trim frame 20. Thus, with the door end caps 83 secured to the legs 22 of the U-shaped door trim frame 20, the U-shaped door trim frame 20 also is connected to the vent trim frame 16 and the handle assembly 51. The first portion 89 of the door end cap 83 is disposed between the vent trim frame 16 and the U-shaped door trim frame 20 as shown in FIG. 12.

As shown in FIG. 4, the substantially horizontal portion 38 of the vent trim frame 16 has a downwardly depending lip 109 to overlie a rolled edge 110 on the end of the substantially horizontal portion 23 of the top portion 21 of the U-shaped door trim frame 20. The lip 109 terminates about 3/16" from each end of the width of the substantially horizontal portion 38 of the vent trim frame 16.

As shown in FIGS. 11 and 12, an externally exposed substantially planar surface 110' of the second portion 90 of the door end cap 83 has a top lip 111 overlying an end of the substantially horizontal portion 38 of the vent trim frame 16 and a side lip 112 (see FIG. 6) overlying an end of the first substantially vertical portion 39 of the vent trim frame 16. The side lip 112 extends slightly beyond the bottom of the first substantially vertical portion 39 of the vent trim frame 16 and the upper edge 14 of the front pane 12 of glass. The planar surface 110' provides an appearance surface which extends over the area of intersection of the vent trim frame 16, the front pane 12 of glass, and the U-shaped door trim frame 20. Since as hereinbefore described, the door end caps 83 are formed of a heat insulating material, the second portion 90 (see FIG. 12) of the door end cap 83 also serves to limit the surface temperature of the appearance surface 110'.

A heat shield/reflector 113 (see FIG. 2), which is formed of any suitable bright surface material and is preferably galvanized steel, is supported by the legs 22 of the U-shaped door trim frame 20. As shown in FIG. 5, the second portion 26 of each of the legs 22 has a pair of punched out holes 114. The heat shield/reflector 113 (see FIG. 2) has a pair of notches 115 at each end of a first substantially vertical portion 116 and in the upper surface thereof. A screw 117 extends through each of the notches 115 in the upper surface of the first substantially vertical portion 116 at each end thereof and into one of the holes 114 in the second portion 26 of each of the legs 22. After the screws 117 pass through the holes 114, the screws 117 enter holes 118 (see FIG. 6) in the third substantially vertical portion 44 of the vent trim frame 16.

The bottom end of the first substantially vertical portion 116 of the heat shield/reflector 113 has an angled portion 119 extending downwardly therefrom. The end of the angled portion 119 of the heat shield/reflector 113 engages the inner surface of the front pane 12 of glass.

The upper end of the first substantially vertical portion 116 of the heat shield/reflector 113 has a substantially horizontal portion 120, which has a second substantially vertical portion 121 extending upwardly therefrom. The second substantially vertical portion 121 of the heat shield/reflector 113 bears against a portion of the inner surface of the first substantially vertical portion 39 of the vent trim frame 16 beneath the grill area 40. The angled portion 119 of the heat shield/reflector 113 also reflects radiant heat radiating from an oven cavity 140 of the range 10.

Figure 6:
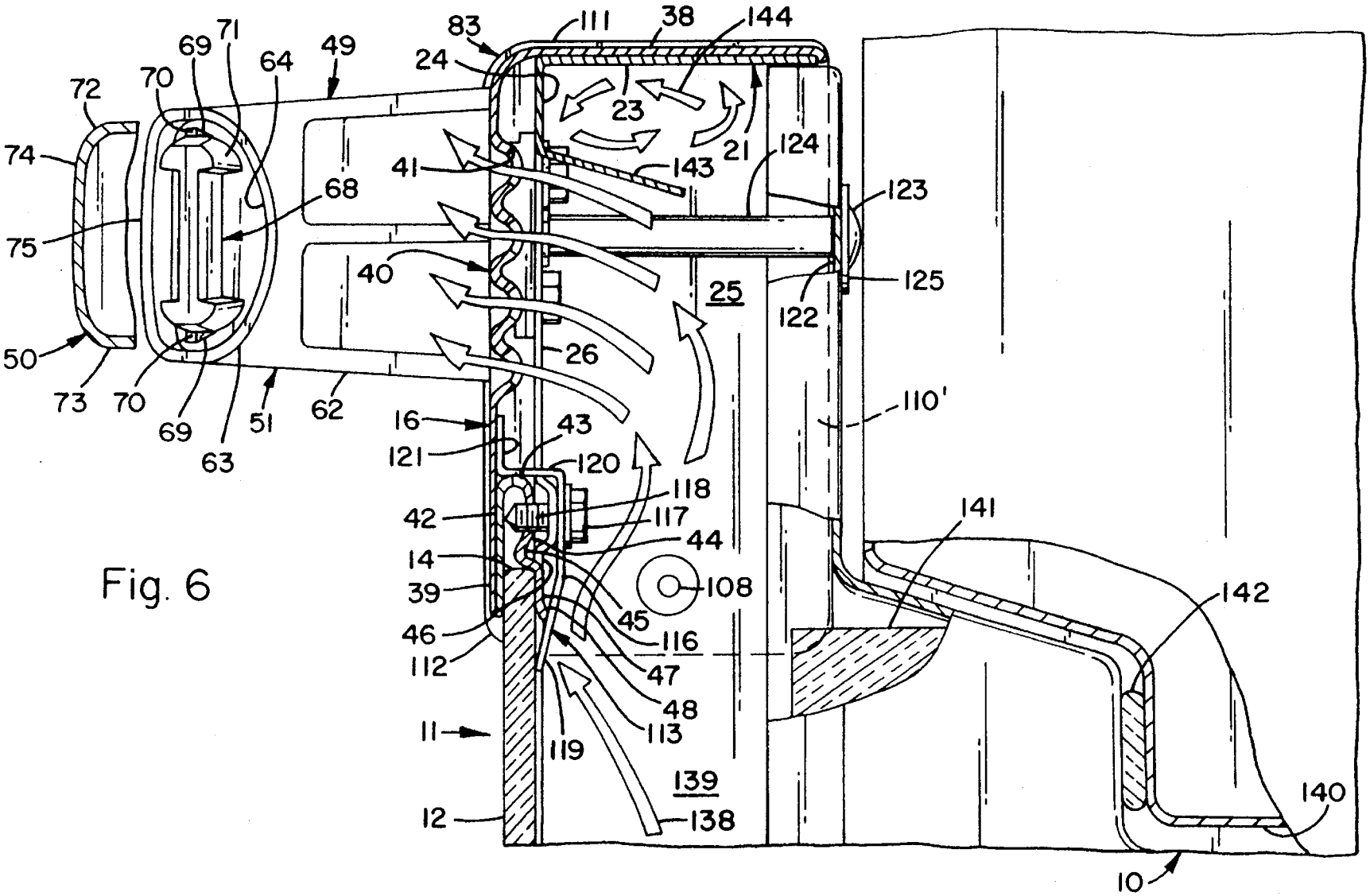
FIG. 6 is an enlarged fragmentary sectional view, partly in elevation, of a portion of the range of FIG. 1 showing an upper portion of the oven door including the substantially vertical air passage of the present invention with arrows showing air flow in the substantially vertical air passage of the present invention and a portion of an oven closed by the oven door.

With the handle assembly 51 (see FIG. 2) attached to the vent trim frame 16, the door end caps 83, and the U-shaped door trim frame 20, the heat shield/reflector 113 secured to the U-shaped door trim frame 20 and the vent trim frame 16, the door end caps 83 attached to the vent trim frame 16 and to the U-shaped door trim frame 20, and the U-shaped door trim frame 20 secured to the bottom trim frame 19 (see FIG. 3) with the front pane 12 of glass retained therebetween, this front or outer trim frame is secured to an inner liner 122 (see FIG. 2). The inner liner 122 has a pair of bolts 123 extending therethrough into the enlarged holes 103 in the substantially vertical portion 24 of the top portion 21 of the U-shaped door trim frame 20. A spacer 124 surrounds each of the bolts 123 to produce a predetermined spacing between the inner liner 122 and the U-shaped door trim frame 20 as shown in FIG. 6.

A washer 125 is disposed between the head of the bolt 123 and the inner liner 122. After passing through the enlarged holes 103 (see FIG. 2) in the substantially vertical portion 24 of the top portion 21 of the U-shaped door trim frame 20, one of the bolts 123 passes through the elongated slot 86 in each side of the first substantially vertical portion 39 of the vent trim frame 16 and then into the hole 59 (see FIG. 9) in the post 56 of each of the handle end caps 49.

Figure 7:
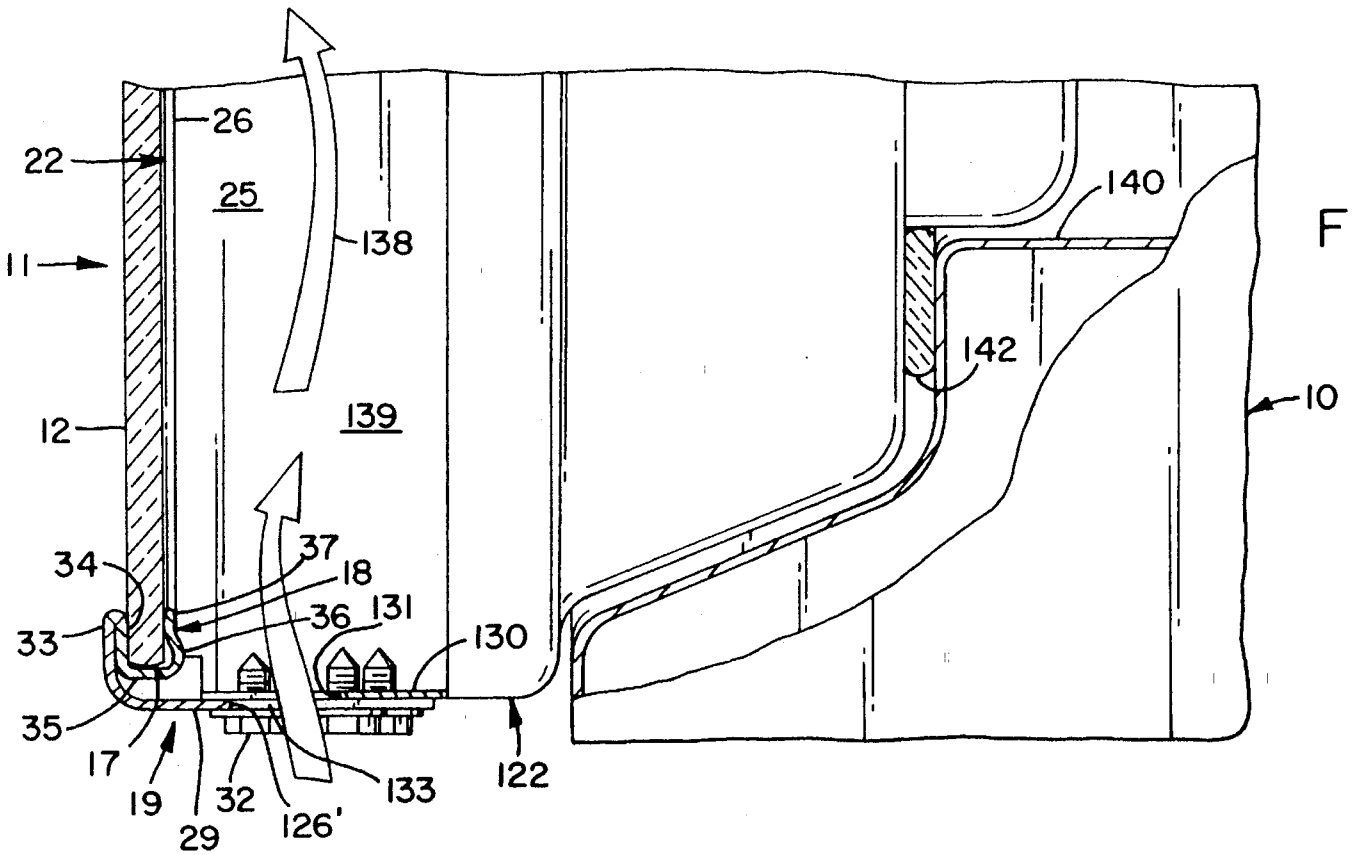
FIG. 7 is a fragmentary sectional view, partly in elevation, of a portion of the range of FIG. 1 showing a lower portion of the oven door including the substantially vertical air passage of the present invention with arrows showing air flow in the substantially vertical air passage.

Referring again to the bottom trim frame 19, as best seen in FIG. 3, the bottom trim frame 19 has four tabs 126 formed along an edge 126' of the first substantially horizontal portion 29 with a hole 127 in each of the tabs 126 to receive a screw 128. Each of the screws 128 also passes through a hole 129 in tabs 130 formed along an edge 131 of a bottom peripheral flange or lip 132 of the inner liner 122 to connect the tabs 126 and 130 to each other. As shown in FIG. 7, the edges 126' and 131 and the overlapping tabs 126 and 130 define air inlet openings 133 therebetween.

The inner liner 122 (see FIG. 2) has an upper peripheral flange or lip 134 disposed beneath the substantially horizontal portion 23 of the top portion 21 of the U-shaped door trim frame 20. The inner liner 122 also has each of its two side peripheral flanges or lips 135 disposed inside of the first portion 25 of each of the two legs 22 of the U-shaped door trim frame 20.

A thermal break is provided between the substantially horizontal portion 23 of the top portion 21 of the U-shaped door trim frame 20 and the upper peripheral flange 134 of the inner liner 122 by a plurality of capsule shaped embossments 136. A thermal break also is provided between each of the legs 22 of the U-shaped door trim frame 20 and each of the side peripheral flanges 135 by a plurality of the capsule shaped embossments 136. Each of the side peripheral flanges 135 preferably has two of the capsule shaped embossments 136, and the upper peripheral flange 134 preferably has five of the capsule shaped embossments 136.

The oven cavity 140 (see FIG. 6) is closed by the inner liner 122, which has suitable heat insulation material 141 therein. A gasket 142 forms a seal between the inner liner 122 of the oven door 11 and the exit of the oven cavity 140 by surrounding the exit of the oven cavity 140.

The heat insulation material 141 is retained within a stepped recess in the inner liner 122. The stepped recess in the inner liner 122 also is shown in FIG. 7.

The oven door 11 is cooled by cooling air which enters the region between the front pane 12 (see FIG. 7) of glass and the inner liner 122 along the lower edge of the oven door 11 and exits from the upper region of the oven door 11 (see FIG. 6) through the vent trim member 16. As shown in FIG. 7 by arrows 138, cooling air is drawn into the oven door 11 by convection through the air inlet openings 133 and flows upwardly through a vertical air passage 139, which is formed between the inner surface of the front pane 12 of glass and the inner liner 122. As shown in FIG. 6 by the arrows 138, the angled portion 119 of the heat shield/reflector 113 tends to deflect the air away from the area of the first substantially vertical portion 39 of the vent trim frame 16 beneath the grill area 40 and the handle assembly 51.

As the air continues to move upwardly in the vertical passage 139 (see FIG. 6) by convection as shown by the arrows 138, the air strikes a baffle 143, which is integral with part of the substantially vertical portion 24 of the top portion 21 of the U-shaped door trim frame 20 but does not extend to the portions having the enlarged holes 103 and the elongated slots 104 and 105. The baffle 143, which is formed at an angle to the substantially vertical portion 24 of the top portion 21 of the U-shaped door trim frame 20, tends to retain the air in the region as indicated by arrows 144, above the baffle 143 resulting in a relatively stagnant mass of air above the baffle 143 which acts as a heat insulator. This stagnant mass prevents additional upwardly flowing air from entering the region above the baffle 143. This air mass in cooperation with the lower surface of the baffle 143 directs the air beneath the baffle 143 directly out through the elongated openings 41 in the grill area 40 in a substantially horizontal direction. The elongated openings 41 and the handle assembly 51 are in substantially the same horizontal plane to utilize the air exiting through the elongated openings 41 to cool the handle assembly 51.

The inner liner 122 (see FIG. 2) has a pair of inner supports 145 to receive the hinge structure supported by the range 10 (see FIG. 1). This is the pivotal mounting arrangement for the oven door 11.

An advantage of this invention is that the thermal design of the oven door provides a relatively cool door for a self-cleaning oven.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. An oven door including:

a front pane of glass having an inner surface and an outer surface and a top edge and a bottom edge;

frame means for supporting said front pane of glass, said frame means including a top and a bottom and opposing sides extending therebetween;

an inner liner attached to said frame means, said inner liner including a bottom edge;

substantially vertical air passage means extending between a lower end and an upper end for directing air over said front pane of glass along its inner surface to cool said front pane of glass;

said substantially vertical air passage means being formed between said frame means and said inner liner;

air inlet means at at least one of the bottom of said frame means and said bottom edge of said inner liner for communication with said substantially vertical air passage means at its lower end to enable air to enter said air passage means;

said frame means having air outlet means disposed above said front pane of glass and communicating with said substantially vertical air passage means to permit air to exit from said substantially vertical air passage means;

said substantially vertical air passage means receiving heat from an oven having an access opening enclosed by said oven door to produce flow of air within said substantially vertical air passage means from said air inlet means to said air outlet means by convection;

deflecting means disposed in said substantially vertical air passage means for deflecting air from said substantially vertical air passage means through said air outlet means;

said deflecting means and said air outlet means cooperating to cause air exiting through said air outlet means to exit in a substantially horizontal direction;

said substantially vertical air passage means having its upper end closed above said deflecting means so that air in said substantially vertical air passage means exits only through said air outlet means;

and said deflecting means being spaced from the upper end of said substantially vertical air passage means to provide a space therebetween in which relatively stagnant air functions as a heat insulator.

2. The oven door according to claim 1 including:

a metallic handle gripping portion;

a pair of support means for supporting opposite ends of said handle gripping portion to space said handle gripping portion from said frame means and dispose said handle gripping portion so that said handle gripping portion is in substantially the same horizontal plane as at least a portion of said air outlet means in said frame means whereby air flows over said handle gripping portion from said air outlet means;

and each of said support means being formed of a heat insulating material to prevent heat transfer from said oven door to said handle gripping portion.

3. The oven door according to claim 2 including heat reflecting means supported by said frame means and disposed within said substantially vertical air passage means operative to direct air flowing within said substantially vertical air passage means away from a portion of said frame means beneath said air outlet means and above the top edge of said front pane of glass.

4. The oven door according to claim 3 in which said heat reflecting means includes an angular portion having its lower end engaging the inner surface of said front pane of glass.

5. The oven door according to claim 4 including heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

6. The oven door according to claim 3 including heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

7. The oven door according to claim 2 including heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

8. The oven door according to claim 1 including heat reflecting means supported by said frame means and disposed within said substantially vertical air passage means operative to direct air flowing within said substantially vertical air passage means away from a portion of said frame means beneath said air outlet means and above the top of said front pane of glass.

9. The oven door according to claim 8 in which said heat reflecting means includes an angular portion having its lower end engaging the inner surface of said front pane of glass.

10. The oven door according to claim 9 including heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

11. The oven door according to claim 8 including heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

12. An oven door including:

a front pane of glass having an inner surface and an outer surface and a top edge and a bottom edge;

frame means for supporting said front pane of glass, said frame means including a top and a bottom and opposing sides extending therebetween;

an inner liner attached to said frame means, said inner liner including a bottom edge;

substantially vertical air passage means extending between a lower end and an upper end for directing air over said front pane of glass along its inner surface to cool said front pane of glass;

said substantially vertical air passage means being formed between said frame means and said inner liner;

air inlet means at at least one of the bottom of said frame means and said bottom edge of said inner liner for communication with said substantially vertical air passage means at its lower end to enable air to enter said air passage means;

said frame means having air outlet means disposed above said front pane of glass and communicating with said substantially vertical air passage means to permit air to exit from said substantially vertical air passage means;

said substantially vertical air passage means receiving heat from an oven having an access opening enclosed by said oven door to produce flow of air within said substantially vertical air passage means from said air inlet means to said air outlet means by convection;

deflecting means disposed in said substantially vertical air passage means for deflecting air from said substantially vertical air passage means through said air outlet means;

said deflecting means and said air outlet means cooperating to cause air exiting through said air outlet means to exit in a substantially horizontal direction;

said substantially vertical air passage means having its upper end closed above said deflecting means so that air in said substantially vertical air passage means exits only through said air outlet means;

a metallic handle gripping portion;

a pair of support means for supporting opposite ends of said handle gripping portion to space said handle gripping portion from said frame means and dispose said handle gripping portion so that said handle gripping portion is in substantially the same horizontal plane as at least a portion of said air outlet means in said frame means whereby air flows over said handle gripping portion from said air outlet means;

and each of said support means being formed of a heat insulating material to prevent heat transfer from said oven door to said handle gripping portion.

13. The oven door according to claim 12 including heat reflecting means supported by said frame means and disposed within said substantially vertical air passage means operative to direct air flowing within said substantially vertical air passage means away from a portion of said frame means beneath said air outlet means and above the top of said front pane of glass.

14. The oven door according to claim 13 in which said heat reflecting means includes an angular portion having its lower end engaging the inner surface of said front pane of glass.

15. The oven door according to claim 14 including heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

16. The oven door according to claim 13 including heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

17. The oven door according to claim 12 including heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

18. An oven door including:

a front pane of glass having an inner surface and an outer surface and a top edge;

frame means for supporting said front pane of glass, said frame means including a top and a bottom and opposing sides extending therebetween;

an inner liner attached to said frame means, said inner liner including a bottom edge;

substantially vertical air passage means extending between a lower end and an upper end for directing air over said front pane of glass along its inner surface to cool said front pane of glass;

said substantially vertical air passage means being formed between said frame means and said inner liner;

air inlet means at at least one of the bottom of said frame means and said bottom edge of said inner liner for communication with said substantially vertical air passage means at its lower end to enable air to enter said air passage means;

said frame means having air outlet means disposed above said front pane of glass and communicating with said substantially vertical air passage means to permit air to exit from said substantially vertical air passage means;

said substantially vertical air passage means receiving heat from an oven having an access opening enclosed by said oven door to produce flow of air within said substantially vertical air passage means from said air inlet means to said air outlet means by convection;

deflecting means disposed in said substantially vertical air passage means for deflecting air from said substantially vertical air passage means through said air outlet means;

said deflecting means and said air outlet means cooperating to cause air exiting through said air outlet means to exit in a substantially horizontal direction;

said substantially vertical air passage means having its upper end closed above said deflecting means so that air in said substantially vertical air passage means exits only through said air outlet means;

and heat reflecting means supported by said frame means and disposed within said substantially vertical air passage means operative to direct air flowing within said substantially vertical air passage means away from a portion of said frame means beneath said air outlet means and above the top edge of said front pane of glass.

19. An oven door including:

a front pane of glass having an inner surface and an outer surface and a top edge and a bottom edge;

frame means for supporting said front pane of glass, said frame means including a top and a bottom and opposing sides extending therebetween;

an inner liner attached to said frame means, said inner liner including a bottom edge;

substantially vertical air passage means extending between a lower end and an upper end for directing air over said front pane of glass along its inner surface to cool said front pane of glass;

said substantially vertical air passage means being formed between said frame means and said inner liner;

air inlet means at at least one of the bottom of said frame means and said bottom edge of said inner liner for communication with said substantially vertical air passage means at its lower end to enable air to enter said air passage means;

said frame means having air outlet means disposed above said front pane of glass and communicating with said substantially vertical air passage means to permit air to exit from said substantially vertical air passage means;

said substantially vertical air passage means receiving heat from an oven having an access opening enclosed by said oven door to produce flow of air within said substantially vertical air passage means from said air inlet means to said air outlet means by convection;

deflecting means disposed in said substantially vertical air passage means for deflecting air from said substantially vertical air passage means through said air outlet means;

said deflecting means and said air outlet means cooperating to cause air exiting through said air outlet means to exit in a substantially horizontal direction;

said substantially vertical air passage means having its upper end closed above said deflecting means so that air in said substantially vertical air passage means exits only through said air outlet means;

and heat insulating means having an appearance surface overlapping each side of said frame means from its top to beneath the top edge of said front pane of glass for preventing exposure of the overlapped portion of each side of said frame means and said front pane of glass and limiting the temperature of said appearance surface.

* * * * *